United States Patent [19]

Debenham

[11] 3,948,415

[45] Apr. 6, 1976

[54] EASY-OPENING CLOSURES

[75] Inventor: Michael Debenham, Frankston, Australia

[73] Assignee: The Broken Hill Proprietary Co., Ltd., Melbourne, Australia

[22] Filed: June 26, 1974

[21] Appl. No.: 483,446

[30] Foreign Application Priority Data

June 27, 1973 Australia ..... 3845/73
July 12, 1973 Australia ..... 4064/73

[52] U.S. Cl. ..... 220/268; 113/121 C; 220/359; 220/266

[51] Int. Cl.[2] ..... B65D 41/32

[58] Field of Search ..... 220/268, 269, 265, 266, 220/359; 113/121 C

[56] References Cited

UNITED STATES PATENTS 2,261,117 11/1941 Jack, Jr. ..... 220/268
3,760,752 9/1973 Geiger ..... 220/268

*Primary Examiner*—George T. Hall
*Attorney, Agent, or Firm*—Cushman, Darby & Cushman

[57] ABSTRACT

This specification discloses improvements in easy-opening closures of the push-in type in which the closure member at least partly overlaps with the aperture surround to define the easy-opening closure. The improvement comprises forming the free edge of the closure member and the aperture surround with interengaging portions which at least substantially inhibit the movement of the closure member relative to the aperture surround. In one preferred form of interengagement the closure member is formed with an upstanding lip and the aperture surround is downwardly turned about said lip. In another form both the aperture surround and the closure member are formed with interengaging lips. In another form the aperture surround is grooved and the lip on the closure member engages the groove. In the last form the aperture surround is formed with a lip which is stamped into the closure member to key the two parts together.

6 Claims, 9 Drawing Figures

EASY-OPENING CLOSURES

This invention relates to push-in closures of the easy-opening type, and more particularly to those in which the closure member is completely sheared from the container member around at least a substantial portion of its periphery.

Push-in closures of the above type have been described in U.S. Pat. No. 3759206. Other push-in closures of this type are known however, and this invention is equally applicable to most closures of this type.

Containers of carbonated beverages are subjected to high internal pressures, such as during pasteurization processes and normal handling under hot conditions, and it is important that a closure be able to withstand such pressures without bursting or leaking and preferably without disturbing the sealant, which is generally used to hermetically seal the closure.

Push-in closures of the above type satisfactorily withstand such pressures when the closure is small in size but when the closure is large, considerable distortion of the closure and its surround may occur. This causes relative movement of the closure and surrounding portions of the container member, possibly causing the sealant to break and in extreme cases causing the closure to burst from the can.

The object of this invention is to provide a closure constructed so as to prevent or substantially inhibit such relative movements and to provide methods of forming such a closure.

The invention provides in an easy-opening closure of the push-in type comprising an aperture in a sheet metal container member and a closure member for said aperture having a free edge, the aperture surround and the free edge of said closure member being in at least partly overlapping relationship, the improvement comprising portions of the free edge of said closure member and the aperture surround being interengaged with each other to such an extent to at least substantially inhibit relative movement of said closure member and said aperture surround.

The interengaged portions may comprise several discrete portions spaced around the closure or may extend about substantially the whole periphery of the closure.

In one preferred form, the closure member is formed with a small upstanding lip, or several discrete lip regions, at its free edge and the aperture surround is formed with a similarly small downturned edge which engages the lip to prevent or substantially inhibit relative movement of closure and surround due to internal pressures in a container having the closure.

The dimensions of the upstanding lip may not be very much larger than that of a burr and may in fact be partly or wholly comprised by a burr formation. Dimensions of the order of 0.005 inch may be acceptable. In any case the dimension need not be greater than half of the thickness of the metal.

In a modified form, the aperture surround is formed with a groove in which the lip is engaged for the same purpose as described above.

The groove may be of any suitable configuration and dimensions provided there is sufficient interengagement between the lip and groove to inhibit said relative movement.

The invention also provides in a method of forming an easy-opening closure of the push-in type in a sheet metal container member comprising forming an aperture in said container member and forming a closure member for said aperture, said closure member having a free edge in at least partly overlapping relationship with the aperture surround, the improvement comprising forming a lip on at least one of said closure member or aperture surround, and interengaging said lip with the other of said aperture surround or closure member.

Several alternative forms of closure and their methods of formation will now be described with reference to the accompanying drawings in which.

Figure 1:
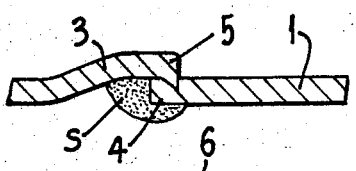
FIG. 1 is a transverse fragmentary cross section of a can end having a first form of closure embodying the invention formed therein.
Figure 1:
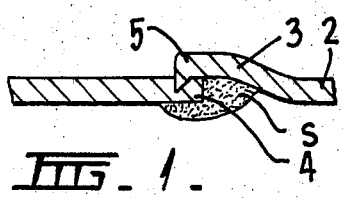

The closure shown in FIG. 1 comprises a closure member 1 which is completely sheared from the can end 2 except for a neck of metal (not shown) which defines a hinge during the opening operation. The edge of the closure 1 and the aperture surround 3 overlap in the manner described in relation to FIGS. 13 to 17 of U.S. Pat. No. 3759206. Sealant S is applied to the closure as shown to form an hermetic seal. As will become apparent below, the preferred methods of forming the closure are modifications of the method described in relation to FIGS. 13 to 17 of the U.S. Patent.

The modification which is the subject of the present application involves the provision of interengaged portions 4 and 5 at the periphery of the closure member 1 and in the aperture surround 3 respectively.

In the first form shown in FIG. 1 the aperture surround 3 is formed with a downwardly extending lip which is keyed into the closure member 1 either by forming a groove in the closure member 1 or by stamping the surround 3 onto the closure member 1 so that the lip grooves the closure. This latter procedure depends on the metal from which the end is formed but since the lip is work hardened during its formation (as described in relation to FIG. 3) it may be sufficiently hard to groove the closure.

Figure 2:
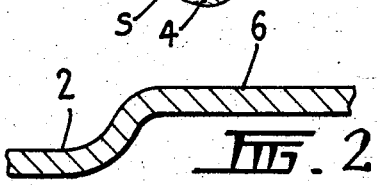
FIGS. 2 to 4 are enlarged views of half of the portion of the end in which the closure is formed showing the three stages in the formation of a first form of closure.
Figure 3:
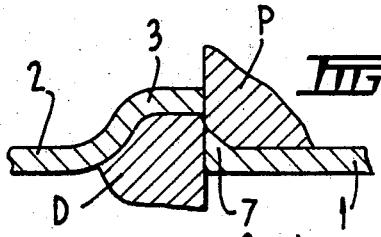
Figure 4:
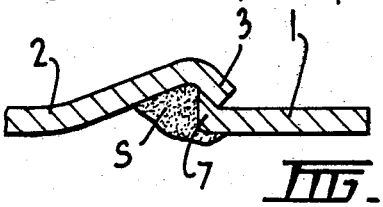

The three steps required to produce the second form of closure and enterengaged portions 4 and 5 embodying the invention are shown in FIGS. 2 to 4.

In the first stage (FIG. 2) the can end 2 is formed with a flat topped bulge 6 by means of a die operation.

In the second stage (FIG. 3) the closure 1 is both sheared from the end 2, displaced downwardly and a small upstanding lip 7 formed at the edge of the closure 1 by means of die operation known as pinch shearing. This operation involves supporting the aperture surround 3 by a die member D and forcing a punch P through the member D, said punch having a 45° chamfer at its edge and of dimensions corresponding to the size of lip 7 required.

In the third stage the still bulged aperture surround 3 is partially flattened to produce the necessary overlap between the surround 3 and the edge of the closure 1 and the edge of the surround 3 is downturned over the upstanding lip 7 so that the two parts firmly interengage.

Figure 5:
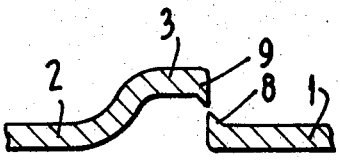
FIGS. 5 and 6 are similar enlarged views of an alternative form of closure showing the last two stages in its formation.
Figure 6:
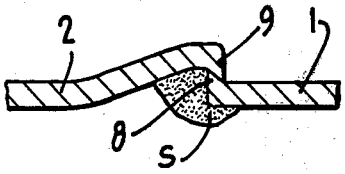

The last two stages in the formation of the closure and the interengaged portions of the third form of the invention are shown in FIGS. 5 and 6, the first stage being the same as described in relation to FIG. 2.

In the second stage (FIG. 5), the closure 1 is sheared from the end 2 and an upstanding lip 8 is formed at the edge of the closure member 1 in the same manner as shown in FIG. 3. At the same time an identical but oppositely extending lip 9 is formed at the edge of the aperture surround 3 by means of an identical die operation.

In the third stage the still bulged aperture surround is partly flattened to produce overlap and to interengage the two lips 8 and 9.

Figure 7:
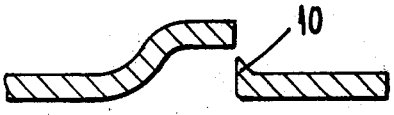
FIGS. 7, 8 and 9 are enlarged views of another alternative form of closure showing the last three stages in its formation.
Figure 8:
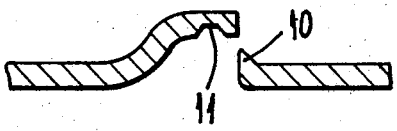
Figure 9:
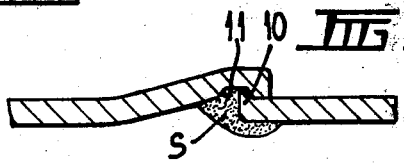

The second to fourth stages of the fourth form of the invention are shown in FIGS. 7 to 9. Again the first stage is as described in relation to FIG. 2.

The second stage (FIG. 7) is identical to the second stage of the first form (FIG. 3) and forms a lip 10 at the edge of the closure member 1. The third stage (FIG. 8) involves scoring of the underside of the aperture surround to form a grooove or notch 11 having a depth substantially corresponding to the height of the lip 10 and having a trapezium-like configuration with the angle of the sloping sides the same as the angle of the inclined side of the lip 10.

Thus, when the surround 3 is flattened (FIG. 9), the lip 10 will engage the groove 11 with the inclined side of the lip 10 in close engagement with the corresponding side of the groove 11. In an alternative not shown, the groove may be shaped similarly to the lip preferably so that the lip is a push fit into the groove.

While in each embodiment described above the overlap between the closure member 1 and aperture surround 3 is produced by flattening a bulge in the surround, other methods may be used to achieve this result. For example the closure member may be cold worked such as by bulging and flattening or by coining, grooving or stretching thereof. Similarly the aperture surround may be coined grooved or stretched, in combination with working of the closure member if desired.

Similarly, the closure need not be formed from the container member, although this is quite clearly preferred for obvious reasons. The improvement of the invention is equally applicable to a separately formed closure which is secured to the can end in overlapping relationship with the aperture surround.

The embodiment of FIGS. 7 to 9 may be modified by forming the lip 10 at the free edge of the aperture surround 3 and by scoring the closure member 1 adjacent the free edge.

I claim:

1. In an easy-opening closure of the push-in type comprising an aperture in a sheet metal container member and a closure member for said aperture having a free edge, the aperture surround and the free edge of said closure member being in at least partly overlapping relationship, the improvement comprising means to interengage portions of the free edge of said closure member and the aperture surround with each other to at substantially inhibit relatively movement of said closure member and said aperture surround in plane of said closure member to prevent separation of the closure member from the aperture surround, said means including an upstanding lip or burr formed on at least one of the closure member free edge and the aperture surround, said lip being no greater than half of the thickness of the sheet metal.

2. Closure of claim 1, wherein the closure member and the aperture surround are interengaged around substantially the whole of the periphery of the closure.

3. Closure of clailm 1, wherein said lip extends upwardly from the free edge of said closure member.

4. Closure of claim 3, wherein the free edge of the aperture surround is turned downwardly about said lip.

5. Closure of claim 3, wherein the free edge of said aperture surround has a downwardly extending lip substantially identical to and interengaged with the lip on said closure member.

6. Closure of claim 3, wherein said aperture surround includes a groove, in which said lip is received.

* * * * *